US006349983B1

(12) United States Patent
Dupont et al.

(10) Patent No.: US 6,349,983 B1
(45) Date of Patent: Feb. 26, 2002

(54) ELECTRIC LOCK FOR A MOTOR VEHICLE DOOR

(75) Inventors: Patrick Dupont, Noyelles sur Mer; Philippe Jacquinet, Nouvion, both of (FR)

(73) Assignee: Valeo Securite Habitacle (FR)

( * ) Notice: Subject to any disclaimer, the term of this patent is extended or adjusted under 35 U.S.C. 154(b) by 0 days.

(21) Appl. No.: 09/397,933

(22) Filed: Sep. 17, 1999

(30) Foreign Application Priority Data

Sep. 21, 1998 (FR) ..... 98 11741

(51) Int. Cl.[7] ..... E05C 3/06
(52) U.S. Cl. ..... 292/201; 292/216
(58) Field of Search ..... 292/216, 201, 292/DIG. 27, DIG. 23; 70/279.1, 282

(56) References Cited

U.S. PATENT DOCUMENTS

| | | | | |
|---|---|---|---|---|
| 4,905,532 A | * | 3/1990 | Fukumoto | 74/425 |
| 5,020,838 A | * | 6/1991 | Fukumoto | 292/201 |
| 5,072,975 A | * | 12/1991 | Hamada | 292/201 |
| 5,564,308 A | * | 10/1996 | Hoshikawa | 74/89.14 |
| 5,615,564 A | * | 4/1997 | Inoue | 70/279 |
| 5,938,253 A | * | 8/1999 | Szablewski | 292/216 |
| 6,145,354 A | * | 11/2000 | Kondo | 70/279.1 |

FOREIGN PATENT DOCUMENTS

| | | |
|---|---|---|
| DE | 24 42 797 A1 | 3/1976 |
| DE | 196 00 524 A1 | 6/1997 |
| DE | 297 01 390 U1 | 11/1997 |
| EP | 0 807 734 A2 | 11/1997 |
| FR | 2 656 030 | 6/1991 |

* cited by examiner

*Primary Examiner*—Gary Estremsky
(74) *Attorney, Agent, or Firm*—Connolly Bove Lodge & Hutz LLP

(57) ABSTRACT

Electric lock for a motor vehicle door, comprising a lock casing (B), of which a first compartment contains a latch and a pawl, and of which a second compartment (15) contains, in sealed manner, a locking lever (41) capable of placing the lock in a locked/unlocked position, and an electric motor (16) for assisting with opening, characterized in that, in the second compartment, the electric motor is capable of rotating, via a set of gears (17–19), a gear wheel (22) with at least one radially eccentric wrist pin (24), the said wrist pin being intended, as the wheel rotates, to drive an operating lever (11) until a radially eccentric peg (23*a*) on the said wheel comes into contact with an elastic end-of-opening travel stop (27), the supply of electric power to the motor being timed to last long enough for the said peg to be sure of reaching the elastic stop, the said operating lever rotating as one with an opening lever arranged in the first compartment and capable of cooperating with the pawl to move it into the position for releasing the latch.

21 Claims, 6 Drawing Sheets

ELECTRIC LOCK FOR A MOTOR VEHICLE DOOR

The present invention relates to a lock for a motor vehicle door, particularly to a lock which is automatically unlocked upon opening, and more specifically, to an electric lock providing assistance with opening and/or assistance with locking.

In electric locks with assistance with opening, the mechanism for opening the lock is driven by a geared motor unit, an electromagnetic system or any other equivalent device which is built into a sealed part of the lock casing, so that the electrical components and gears can be isolated from dust, water and any foreign body which could enter the lock, when the vehicle is in use. The electric mechanism for assisting with opening is generally operated via the exterior handles or paddles for opening the door, which are fitted with a contactor, sensor, microswitch or any other detector which is connected by an electric cable to the device for assisting with opening the lock, in order to transmit the command to open. Given that the exterior handles or paddles are exposed to adverse weather conditions, it is necessary to make the opening detectors, and their electric cables and connectors, completely sealed, and this increases the cost of the lock.

A first object of the invention is to provide an electric lock with assistance with opening which minimizes the electrical connections and the sealing constraints, in order to reduce the cost of the lock.

The second object of the present invention is to provide an electric lock with assistance with opening, the layout of the mechanisms of which is improved.

For safety reasons, locks for front doors and sometimes for rear doors are generally equipped with a mechanism for automatically unlocking on opening, when the user actuates the interior door handle. This is because, if a user is driving along in the locked position, for example, so that he or she runs no risk of being attacked when he or she stops at traffic lights, it is important that, in the event of an accident, he or she can easily get out of his or her vehicle without having first of all to unlock the door before being able to open it.

Another advantage is that the user, by actuating the interior door handle, is able, in a single action, both to unlock and to open the door, whereas it would be somewhat troublesome, for a user, to have to unlock the door before being able to open it.

Furthermore, in instances when the driver of the vehicle, having got out, closes the door again leaving the keys inside, he or she can go back into the vehicle because the door will have automatically unlocked upon opening, something which would not have been the case if it had been possible for the door to be opened from the inside without unlocking the lock.

However, this function of automatically unlocking upon opening, also known by the name of "override" does consume energy, because the energy needed for unlocking is in addition to the energy required for opening the lock. This energy may be supplied via manual effort on the part of the user, in the case of an entirely mechanical lock, or by mechanisms providing electrical assistance with opening and unlocking, in the case of an electric lock.

The third object of the invention is to provide a lock with automatic unlocking on opening, which reduces the energy that has to be supplied in order to fulfill such a function.

Customarily, locks, both electric and mechanical, comprise a great many levers: a lever for opening from the outside, a lever for opening from the inside, a lever for locking from the inside, a lever for locking from the outside, and one or more intermediate levers. Furthermore, these levers are connected by linkage means, for example linkages, cables and cable sheaths, to operating means, such as the lock barrel and the interior and exterior handles or paddles.

The fourth object of the invention is to provide a simplified lock for a vehicle door, which minimizes the number of levers and linkage means for fulfilling the various functions of the lock.

In order to achieve the first aforementioned objective, the first subject of the invention is an electric lock for a motor vehicle door comprises a lock casing, of which a first compartment, known as the retention compartment, contains a latch capable of retaining a striker, and a pawl for locking the latch in the striker-retaining position, and of which a second compartment, known as the driveline transmission compartment, contains, in sealed manner, a mechanism for locking the lock, comprising a locking lever capable of placing the lock in the locked/unlocked position, and an opening mechanism comprising an electric motor for assisting with opening, capable of driving a lever for opening from the outside, so as to actuate the pawl into its position for releasing the latch, in response to a control signal for opening from the outside emitted by a contactor for opening from the outside, when an external operating means, such as an exterior door handle or paddle, is actuated by a user, characterized in that it comprises an outside mechanical linkage means, an outer portion of which is intended to be connected to the means for operating from the outside, and another, inner, portion of which extends into the sealed second compartment of the lock, the said contactor for opening from the outside being arranged in the said sealed second compartment on the path of the said inner portion of the outside mechanical linkage means, so as to emit an opening-from-the-outside control signal when the mechanical linkage means is moved over a determined opening travel when the means for operating from the outside is being actuated.

Thus, all the electrical connections between the exterior door handle and the lock are dispensed with, and it is no longer necessary to seal the contactor, because it is located in a compartment of the lock which is already sealed.

In a particular embodiment, the inner portion of the mechanical linkage means is secured to a slider which is guided by a slideway inside the sealed second compartment, along the opening travel of the mechanical linkage means, and which is capable of cooperating, at the end of opening travel, with the contactor to trigger the emission to the electric motor of the opening control signal.

Advantageously, the lock of the invention is associated with a so-called "hands free" remote recognition system which is intended to supply power to the electric motor when an authorized user has been identified by the said recognition system, near to the vehicle. Such a recognition system is known per se and consists in providing a badge fitted with an emitter worn or carried by the user and a receiver implanted in the vehicle which controls the supply of electrical power to the vehicle when it receives an appropriate coded signal emitted by the badge. Thus, when the authorized user actuates the exterior door handle, opening is triggered automatically, without the lock having necessarily to have been unlocked beforehand. Specifically, the lock may be unlocked before, at the same time as, or after electrically controlled opening. Given that it is not necessary for the lock to be unlocked in order for the lock to be opened from the outside, opening may occur more quickly. The fact that prior unlocking of the lock is not necessary does not constitute a drawback, because the lock can be opened directly only if an authorized user has been identified by the recognition system, failing which the electric motor will not be powered, and opening will therefore be impossible.

Unlike known locks, in which action on the exterior handle first of all brings about unlocking then brings about opening, the lock of the invention has two parallel driveline transmission lines, one for electrical opening, the other for unlocking.

It will be noted that the opening travel of the linkage means for triggering electrical opening may be short, for example of the order of 5 mm.

According to another feature of the invention, the inner portion of the mechanical linkage means comprises, at its free end, an endpiece capable of causing an emergency opening lever to pivot, in the event of an electrical fault or in the event of the vehicle battery being flat, by moving the said linkage means, under the action of the means for operating from the outside, over an additional travel beyond the electrical opening travel, the said emergency lever being capable of moving, during the said additional travel, the lever for opening from the outside, so as to release the latch.

Advantageously, the emergency lever is subject to the action of a very stiff spring which returns it to its position of rest, which means that the user has to force the means for operating from the outside in order to actuate the emergency lever, so that the user will not needlessly actuate the emergency lever when electrical assistance with opening is working.

According to yet another feature, the locking lever is able, when the lock is locked, to place the aforementioned endpiece of the linking means in a position in which the endpiece escapes the action of the emergency lever, irrespective of the movement of the linkage means, and, when the lock is unlocked, to place the said endpiece in a position in which it cooperates with the emergency lever, during the additional travel.

Advantageously, the linking means is a flexible cable and the locking lever comprises an arm capable of moving the endpiece of the cable, to alter the path of the cable, so that the said endpiece escapes the action of the emergency lever when the lock is locked.

In a particular embodiment, the emergency lever comprises a fork, between the branches of which the linking cable passes, the separation of the branches being less than the size of the endpiece, so that the latter can drive the emergency lever, when the lock is in the unlocked position. In this case, the branches of the fork may, at their free end, have a guide ramp for guiding the endpiece along the path of the cable in its escaped position, when the cable is moved under the action of the means for operating from the outside.

According to yet another feature, the lock comprises a means of automatically unlocking on opening, comprising a first lever equipped with a cam follower element arranged in the first, retention, compartment for cooperating with a cam profile provided on the latch, and a second lever arranged in the sealed second compartment and capable of cooperating with a abutment provided on the locking lever so that as the latch rotates towards its open position, the cam profile causes a movement of the cam follower element and consequently of the second lever which rotates as one with the first lever, to automatically bring the locking lever into its unlocked position.

In this case, the second lever of the means of automatically unlocking on opening is capable, when the latch is in the open position, of immobilizing the abutment of the locking lever to prevent the lock from being locked in the door-open position.

To achieve the aforementioned second objective, the second subject of the invention is an electric lock for a motor vehicle door, comprising a lock casing, of which a first compartment, known as the retention compartment, contains a latch capable of retaining a striker and a pawl for immobilizing the latch in the striker-retaining position, and of which a second compartment, known as the driveline transmission compartment, contains, in sealed manner, a locking mechanism comprising a locking lever capable of placing the lock in a locked/unlocked position, and an opening mechanism comprising an electric motor for assisting with opening, characterized in that, in the second, driveline transmission, compartment, the electric motor is capable of rotating, via a set of gears, a gear wheel with at least one radially eccentric wrist pin, the said wrist pin being intended, as the wheel rotates, to drive an operating lever until a radially eccentric peg on the said wheel comes into contact with an elastic end-of-opening travel stop, the supply of electrical power to the motor being timed to last for long enough, for example 100 ms, for the said peg to be sure of reaching the elastic stop, the said operating lever rotating as one with an opening lever arranged in the first, retention, compartment and capable of cooperating with the pawl to move it into the position for releasing the latch.

In a particular embodiment, the set of gears comprises a first pinion secured to the drive shaft of the electric motor and meshing with a second pinion secured to a worm which meshes peripherally with the said gear wheel, the said worm being connected to a spiral return spring which is intended to make the worm rotate in the opposite direction when the power supply to the motor is cut, thus causing the wrist pin of the gear wheel to return to its initial position.

According to yet another feature of the invention, the locking mechanism comprises a reversible second electric motor for assisting with locking/unlocking the lock when central locking or unlocking is commanded from outside or inside, the drive shaft of the second electric motor being fitted with a pinion meshing with a toothed sector of the locking lever.

Advantageously, the electric motor for assisting with opening is intended to drive the opening lever in response to a control signal emitted by a contactor for opening from the outside, when an external operating means, such as an exterior door handle or paddle, is activated by a user.

In this case, the lock may comprise an outside mechanical linkage means, an outer portion of which is intended to be connected to the means for operating from the outside, and another, inner, portion of which extends into the sealed second compartment of the lock, the said contactor for opening from the outside being arranged in the said sealed second compartment on the path of the said inner portion of the outside mechanical linkage means, so as to emit an opening-from-the-outside control signal when the mechanical linkage means is moved over a determined opening travel when the means for operating from the outside is being actuated.

According to yet another feature, the pawl is connected to a means for operating from the inside, such as an interior door handle or paddle, by means of a mechanical linkage means such as a cable or linkage, to bring the pawl into a position for releasing the latch.

In a particular embodiment, the locking lever comprises three arms: a first arm for placing a mechanical means of linking to a means for operating from the outside in a locked or unlocked position; a second arm for possibly linking with a lock cylinder; and a third arm for possibly linking with a member for operating the door from the inside. This member for operating from the inside is intended to replace the lock stalk customarily used.

In an alternative embodiment, the opening mechanism comprises an emergency lever for mechanical opening in the event of an electrical fault or failure of the vehicle battery, this emergency lever comprising a first branch intended to cooperate with a peg projecting from the operating lever, and a second branch intended to cooperate with a mechanical means of linking to a means for operating from the outside, when the lock is in the unlocked position.

According to yet another feature of the invention, the lock comprises a means of automatically unlocking upon opening, comprising a first lever equipped with a cam follower element arranged in the first, retention, compartment to cooperate with a cam profile provided on the latch, and a second lever arranged in the sealed second compartment and capable of cooperating with a abutment provided on the locking lever, so that as the latch rotates into its open position, the cam profile causes a movement of the cam follower element and consequently of the second lever which rotates as one with the first lever, to automatically bring the locking lever into its unlocked position.

In this case, the second lever of the means of automatically unlocking on opening is capable, when the latch is in the open position, of immobilizing the abutment of the locking lever so as to prevent the lock from being locked in the door-open position.

To achieve the aforementioned third objective, the third subject of the invention is a lock for a motor vehicle door, comprising a latch capable of retaining a door striker, a pawl for immobilizing the latch in the striker-retaining position, an opening mechanism comprising at least one actuating means capable of cooperating with the pawl to bring it into a position for releasing the latch, under the action of a means for operating from the inside or the outside, and a locking mechanism comprising a locking lever for placing the lock in a locked or unlocked position, characterized in that it comprises a means for automatically unlocking upon opening comprising, on the one hand, a cam follower element cooperating with a cam profile provided on the latch and, on the other hand, a bearing portion capable of cooperating with a abutment provided on the locking lever so that as the latch rotates towards its open position, the cam profile causes a movement of the cam follower element and consequently of the said bearing portion so as to automatically bring the locking lever into its unlocked position. Thus, under the action of the means for operating from the inside or the outside, when the pawl releases the latch, the latter is driven into its open position, under the reaction force of the compressed door seal, which automatically causes the lock to unlock, without any unlocking force needing to be. provided. What actually happens is that when a door is closed, the seals are compressed and exert a reaction force of the order of 150 N to 500 N on the latch. In consequence, when the pawl releases the latch, the reaction force of the seal causes the latch to pivot, moving the door ajar and at the same time unlocking it. Use is thus made of the energy stored up in the door seals, which energy was not currently used for unlocking purposes.

Advantageously, in the latch-open position, the bearing portion of the means of automatically unlocking on opening immobilizes the abutment of the locking lever, and this prevents the lock from being locked in the door-open position.

In a particular embodiment, the means of automatically unlocking on opening comprises a first lever equipped with a cam follower peg cooperating with the cam profile of the latch, and a second lever which rotates as one with the first lever and is equipped with the said bearing portion capable of cooperating with a abutment peg on the locking lever.

Advantageously, the cam follower peg of the first lever is capable of cooperating with a door opening contactor at the end of rotational travel of the latch into its open position, the said door opening contactor intended to emit a signal corresponding to information that the door is open to a central processing unit so as to activate, in a way known per se, for example a light indicator on the vehicle dashboard or a lamp in the ceiling of the cabin.

Advantageously, the means of automatically unlocking on opening brings the locking lever into the unlocked position before the end of the opening travel of the latch.

In a particular embodiment, the locking mechanism comprises a reversible electric motor for driving the locking lever between its locked and unlocked positions when central-locking or central-unlocking is operated from the outside or from the inside.

Provision may also be made for the lock of the invention to be associated with an impact sensor so that when an impact is detected, a control signal is sent to the electric motor of the locking mechanism to drive the locking lever into its unlocked position. Thus, if, because of an impact, the door cannot open sufficiently, which means that the latch cannot rotate enough to actuate the means of automatically unlocking on opening, the lock will nonetheless be unlocked.

According to another feature, the aforementioned actuating means comprises a mechanical linkage means, such as a cable or linkage, connecting the pawl to a means for operating from the inside, for example an interior door handle or paddle.

According to yet another feature, the actuating means comprises a lever for opening from the outside, capable of cooperating with the pawl to bring it into the position for releasing the latch, the said lever for opening from the outside being able to be driven by an electric motor for assisting with opening, in response to a control signal emitted by a contactor for opening from the outside, when a means for operating from the outside is actuated by the user.

In this case, the lock may comprise an outside mechanical linkage means, an outer portion of which is intended to be connected to the means for operating from the outside, and another, inner, portion of which extends into the sealed second compartment of the lock, the said contactor for opening from the outside being arranged in the said sealed second compartment on the path of the said inner portion of the outside mechanical linkage means, so as to emit an opening-from-the-outside control signal when the mechanical linkage means is moved over a determined opening travel when the means for operating from the outside is being actuated.

To achieve the aforementioned fourth objective, the fourth subject of the invention is a lock for a motor vehicle door, comprising a latch capable of retaining a striker, a pawl for immobilizing the latch in the striker-retaining position, a mechanism for opening from the outside for actuating the pawl into its position for releasing the latch, an outside mechanical linkage means, an outer portion of which is intended to be connected to a means for operating from the outside, such as an exterior door handle or paddle, and an inner portion of which extends inside the lock casing and is capable of actuating the mechanism for opening from the outside, so as to open the lock, in response to actuation of the means for operating from the outside, and a locking mechanism comprising a bi-stable locking lever for placing the lock in a locked or unlocked position, characterized in that the locking lever is capable of altering the path of the inner portion of the mechanical linkage means so that when the lock is in the locked position, the said inner portion of the mechanical linkage means escapes the action of the mechanism for opening from the outside and so that when the lock is in the unlocked position, the inner portion of the mechanical linkage means is placed in a position in which it cooperates with the mechanism for opening from the outside.

Advantageously, the outside mechanical linkage means is a flexible cable comprising, at the free end of its inner portion, an endpiece which is able to be moved by an arm of the locking lever in a direction roughly perpendicular to the direction of travel of the cable. The mechanism for opening from the outside may comprise an actuating lever equipped, at one end, with a fork, between the branches of which the inner portion of the cable passes when the lock is in the unlocked position, the separation of the branches being less than the size of the said endpiece so that the latter can drive the said actuating lever, the inner portion of the cable and its endpiece escaping the action of the said fork when the lock is in the locked position. Thus, the inherent flexibility of the linking cable is used to disengage the link between the means for operating from the outside and the mechanism for opening from the outside, for locking the lock. When the locking lever is returned from its locked position to its unlocked position, the cable, because of its inherent elasticity, returns to its position in which it is engaged with the fork of the actuating lever.

In this case, the branches of the fork may, at their free end, comprise a guide ramp for guiding the endpiece of the cable into its escaped locking position when the cable is pulled under the action of the means for operating from the outside.

According to another feature, the lock comprises a means of automatically unlocking upon opening comprising, on the one hand, a cam follower element cooperating with a cam profile provided on the latch and, on the other hand, a bearing portion capable of cooperating with a abutment provided on the locking lever so that as the latch rotates into its open position, the cam profile causes a movement of the cam follower element and consequently of the said bearing portion so that the locking lever is automatically brought into its unlocking position.

In a particular embodiment, the inner portion of the mechanical linkage means is secured to a slider which is guided by a slideway inside a sealed compartment of the lock, along the opening travel of the mechanical linkage means, and which is capable, at the end of opening travel, of cooperating with a contactor for opening from the outside, to trigger the emission to an electric motor for assistance with opening of an opening control signal, which electric motor is capable of driving a lever for opening from the outside in order to actuate the pawl.

According to another feature of the invention, the said actuating lever is an emergency opening lever, for use in the event of an electrical failure or in the event of the vehicle battery being flat, capable of being moved by the linkage means under the action of the means for operating from the outside, over an additional travel beyond the opening travel needed to actuate the contactor, the said emergency lever being capable, during the said additional travel, of moving the lever for opening from the outside, so as to release the latch.

Advantageously, the emergency lever is subject to the action of a very stiff spring which returns it to its position of rest, which means that the user has to force the means for operating from the outside in order to actuate the emergency lever, so that the user will not needlessly actuate the emergency lever when electrical assistance with opening is working.

In a particular embodiment, the locking mechanism comprises a reversible electric motor for driving the locking lever between its locked and unlocked positions.

The four subjects of the invention may be taken alone or in combination with each other.

The description given below, purely by way of non-limiting illustration, of one embodiment will, with reference to the appended drawings, allow a better understanding of the invention.

Figure 1:
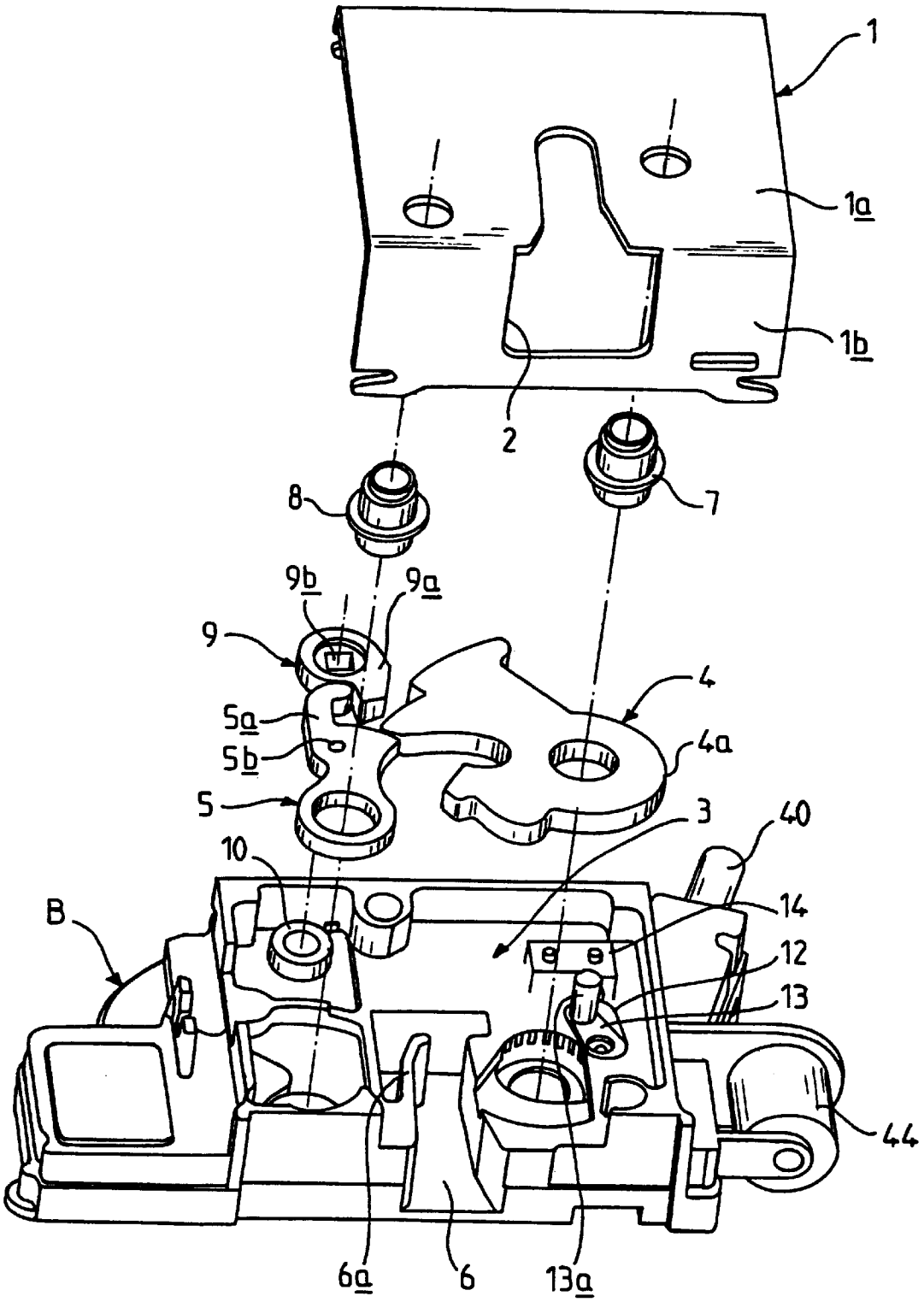
FIG. 1 is an exploded perspective view of the lock according to the invention, from its retention compartment side.
Figure 2:
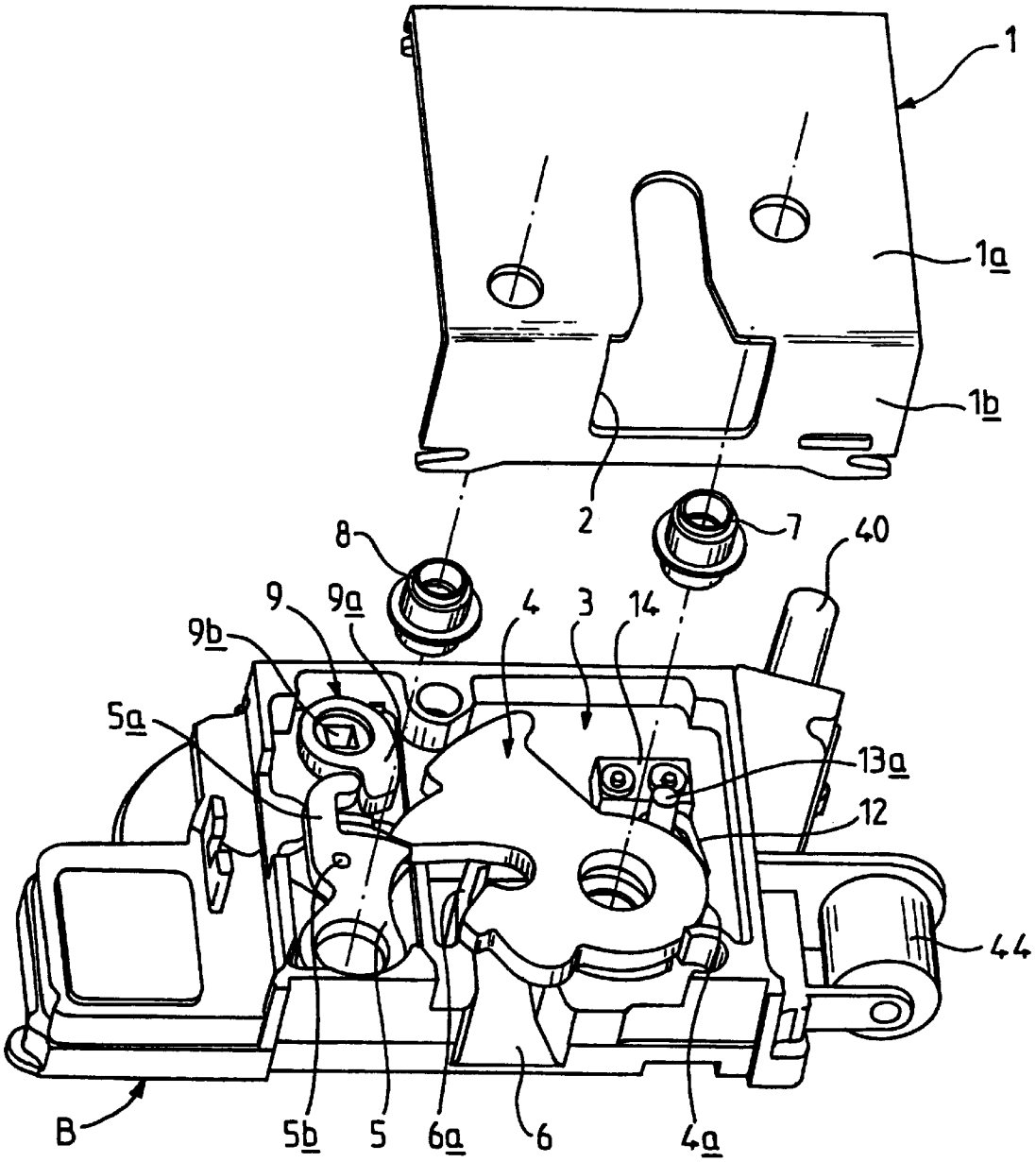
FIG. 2 is a view similar to FIG. 1, but partially assembled.

Referring to FIG. 1, the lock of the invention comprises a lock casing B, for example made of plastic, and a metal backplate 1 roughly in the shape of an angle section and having an opening 2 for the passage of a striker (not depicted) which is fixed, in a way known per se, to a vertical upright of the chassis of a motor vehicle. The backplate 1 has a roughly L-shaped profile, the longer wing 1*a* of which extends in the transverse direction of the vehicle, in the door-closed position, and the shorter wing 1*b* of which extends in the longitudinal direction of the vehicle.

As visible in FIG. 1, the casing B has a roughly right-angled parallelepipedal shape, the longest dimension of which extends roughly in the vertical direction of the door. The casing B comprises a first compartment 3 known as the retention compartment, because it contains a forked latch 4 capable of retaining the striker and a pawl 5 for immobilizing the latch 4 in the striker-retaining position. The retention compartment 3 comprises a recess 6 forming the throat of the lock, for accommodating the striker therein when the door is in the closed position. The compartment 3 is closed by the backplate 1 which is that part of the lock that lies flush with the edge of the door. The latch 4 and the pawl 5 are articulated respectively on lengths of shaft 7 and 8 which are inserted between the bottom of the compartment 3 and the part 1*a* of the backplate 1.

The retention compartment 3 further comprises a lever 9 for opening from the outside, which is articulated on a cylindrical sleeve 10 on the bottom of the compartment 3, the lever 9 for opening from the outside comprising an arm 9*a* extending roughly radially to cooperate with a finger 5*a* of the pawl 5. The lever 9 for opening from the outside has a passage 9*b* of square cross section aligned with the axis of the cylindrical sleeve 10, so that it can be secured in terms of rotation to an operating lever 11 which will be described in greater detail with reference to FIG. 5.

The pawl 5 further comprises a projecting peg 5*b* intended to be connected to a linkage or to a cable (not depicted) so that it can be linked to an interior door handle or paddle.

Figure 4:
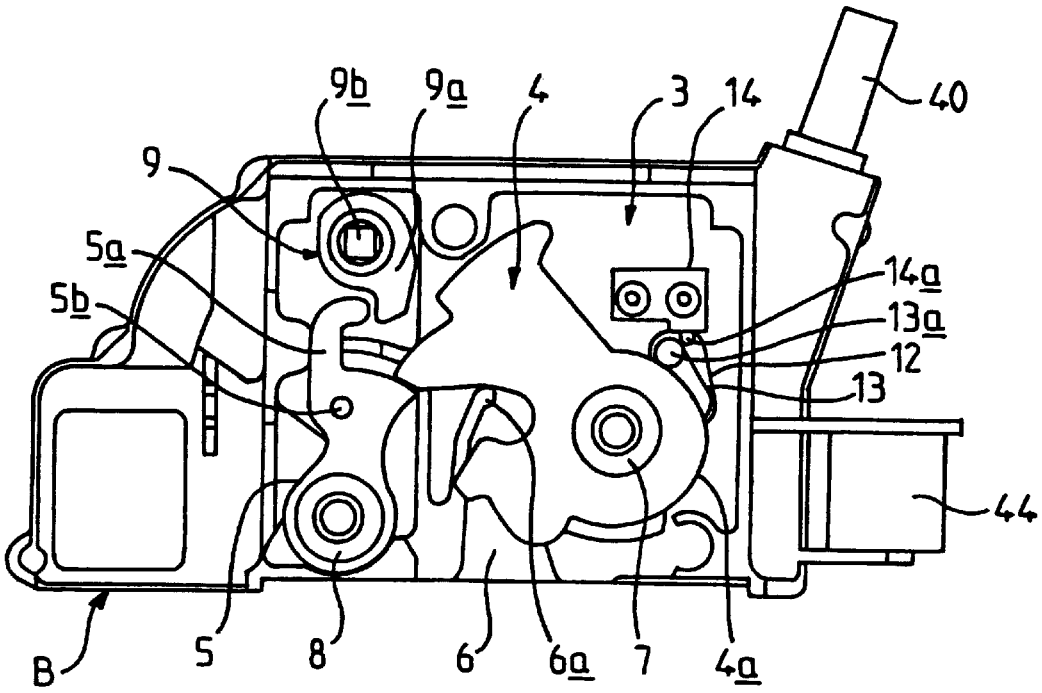
FIG. 4 is a view similar to FIG. 3, the backplate omitted.
Figure 3:
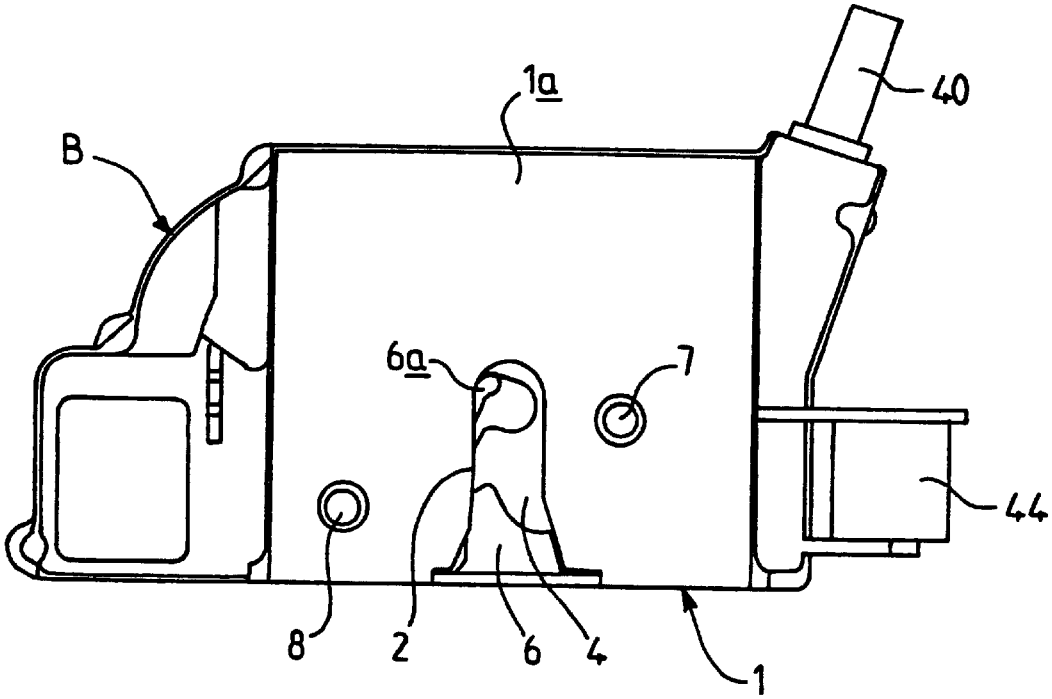
FIG. 3 is a view from above of FIG. 2, with the lock in the fully assembled position.

As can be seen better in FIGS. 1 and 4, a slot 12 is made through the bottom of the compartment 3 near the periphery of the latch 4. A lever 13 which, at its free end, has a projecting peg 13*a* which forms a cam follower element in contact with a peripheral portion 4*a* on the periphery of the latch is able to pivot inside this slot 12, this peripheral portion 4*a* forming a cam profile, the radius of curvature of which is designed to cause the peg 13*a* to move, as the latch 4 rotates, between its closed position illustrated in FIGS. 1 to 4 and its open position (not depicted) pivoted in the counter-clockwise direction.

A door-open contactor 14 is mounted on the bottom of the compartment 3 near the projecting peg 13*a* of the lever 13, so that at the end of pivoting travel of the latch 4 towards its open position, the peg 13*a* pushes a button 14*a* of the contactor 14, to trigger the emission of a door-open signal.

In a way known per se, the throat 6 comprises an elastic tab 6*a* which is intended to damp the entry of the striker into the throat.

Figure 5:
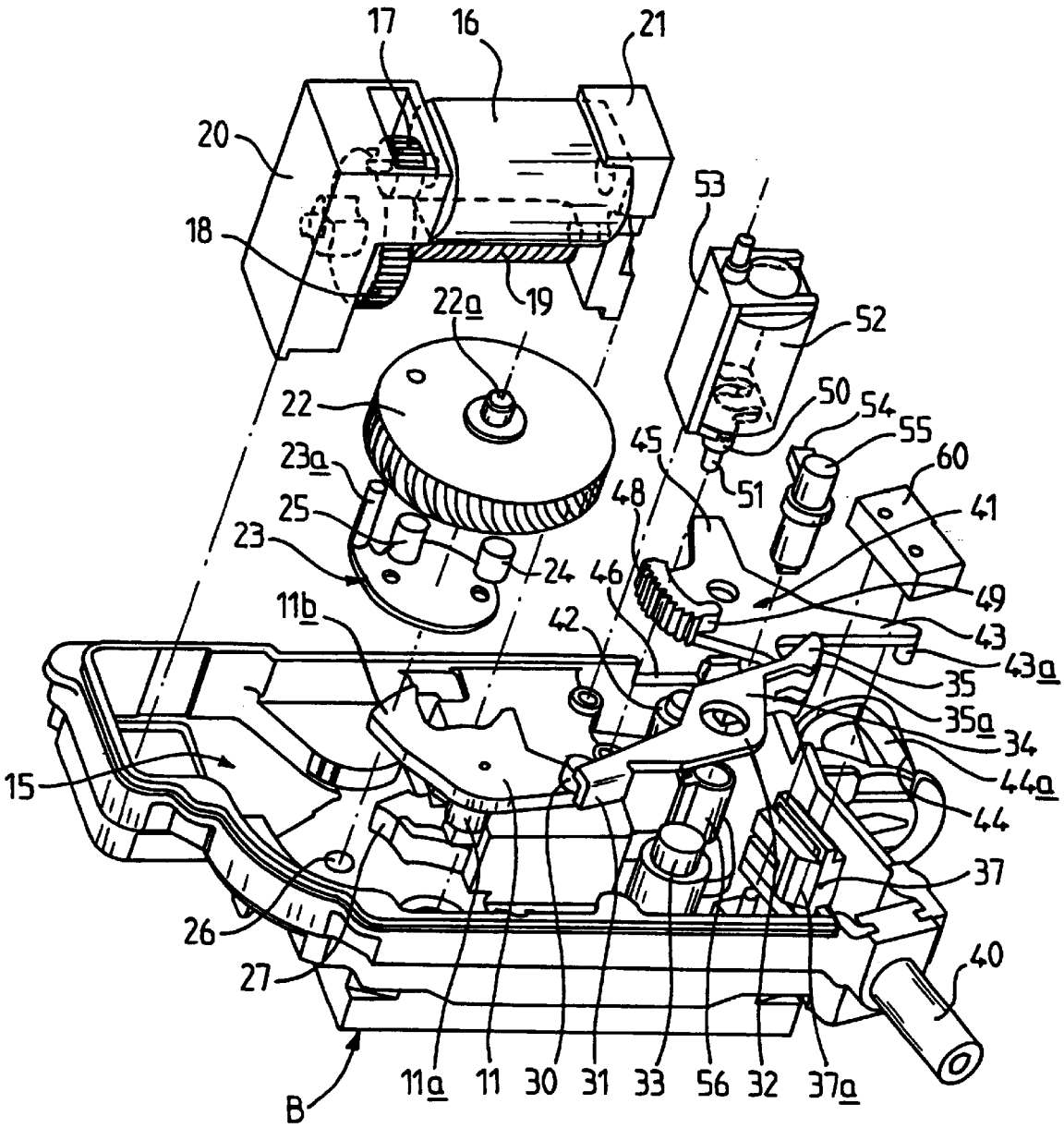
FIG. 5 is an exploded perspective view of the lock of the invention, from its driveline transmission compartment side.

Reference will now be made to FIG. 5 for a description of the components of a second compartment 15, known as the driveline transmission compartment, of the lock casing B. This second compartment 15 is separated in sealed manner from the compartment 3 by a partition which forms the end wall common to both compartments.

The operating lever 11 comprises a length of shaft 11*a* which projects at right angles towards the bottom of the compartment 15 and which is inserted through the cylindrical sleeve 10 of the first compartment 3, this length of shaft 11*a* having, at its free end, a square section so that it can be fitted into the corresponding square-section opening 9*b* in the lever 9 for opening from the outside, to make them rotate as one.

The second compartment 15 contains a first electric motor 16, on the drive shaft of which there is coaxially mounted a first pinion 17 which meshes with a larger-diameter pinion 18 which is coaxially secured, in terms of rotation, to a worm 19. The assembly 16 to 19 forms a geared motor unit which is borne by support bearings 20, 21 which are anchored to the bottom of the compartment 15. The worm 19 meshes with the circumference of a gear wheel 22 which, on its upper face, comprises a length of shaft 22*a* intended to be inserted in a suitable housing in the cover (not depicted) which closes the second compartment 15. Via its underside, the gear wheel 22 is connected, by two wrist pins 24, 25 which are diametrically opposed with respect to the axis of rotation of the wheel 22, to a plate 23. The plate 23 further comprises a finger 23*a* projecting at right angles from its plane and which fits into the underside of the wheel 22. This finger 23*a* is radially further off-center than the wrist pins 24 and 25. Although this is not visible in FIG. 5, the plate 23 on its underside has a length of shaft aligned with the length of shaft 22*a* of the wheel 22 and intended to be inserted in an appropriate housing 26 in the bottom of the compartment 15.

One of the two aforementioned wrist pins, namely the wrist pin 24 furthest from the finger 23*a* of the plate 23, is intended to cooperate with one arm 11*b* of the operating lever 11, to rotate it, as the wheel 22 rotates. The rotation of the operating lever 11 simultaneously causes the lever 9 for opening from the outside to rotate in the retention compartment 3 to move the pawl 5 towards the position for releasing the latch. The wheel 22 continues to rotate until the finger 23*a* of the plate 23 comes into contact with an elastic end-of-travel stop 27 provided on the bottom of the compartment 15. This stop 27 is advantageously made of rubber, so that it deadens the impact of the finger 23*a* against this stop 27, because the drive provided by the motor 16 is relatively forceful.

Although this is not depicted, the operating lever 11 is subject to the action of a return spring, to cause the operating lever 11 to return to its initial position once the gear motor unit has itself returned to its initial position as will be explained further on. A rubber stop 28 may also be provided in the compartment 15 to damp the return of the operating lever 11 to its position of rest, as visible in FIGS. 6 to 9.

The operating lever 11 comprises, at the free end of another arm, extending roughly in the opposite direction to the arm 11*b*, a peg 30 intended to cooperate with a downward curved tab 31 provided at the free end of one arm of an emergency lever 32. The emergency lever 32 is mounted so that it can pivot on a length of shaft 33 which projects from the bottom of the compartment 15 and comprises, at the free end of another arm 34, arranged roughly in an opposite direction to the arm bearing the bent tab 31, a fork 35, the two branches of which have a guide ramp 35*a* at their free end.

Figure 6:
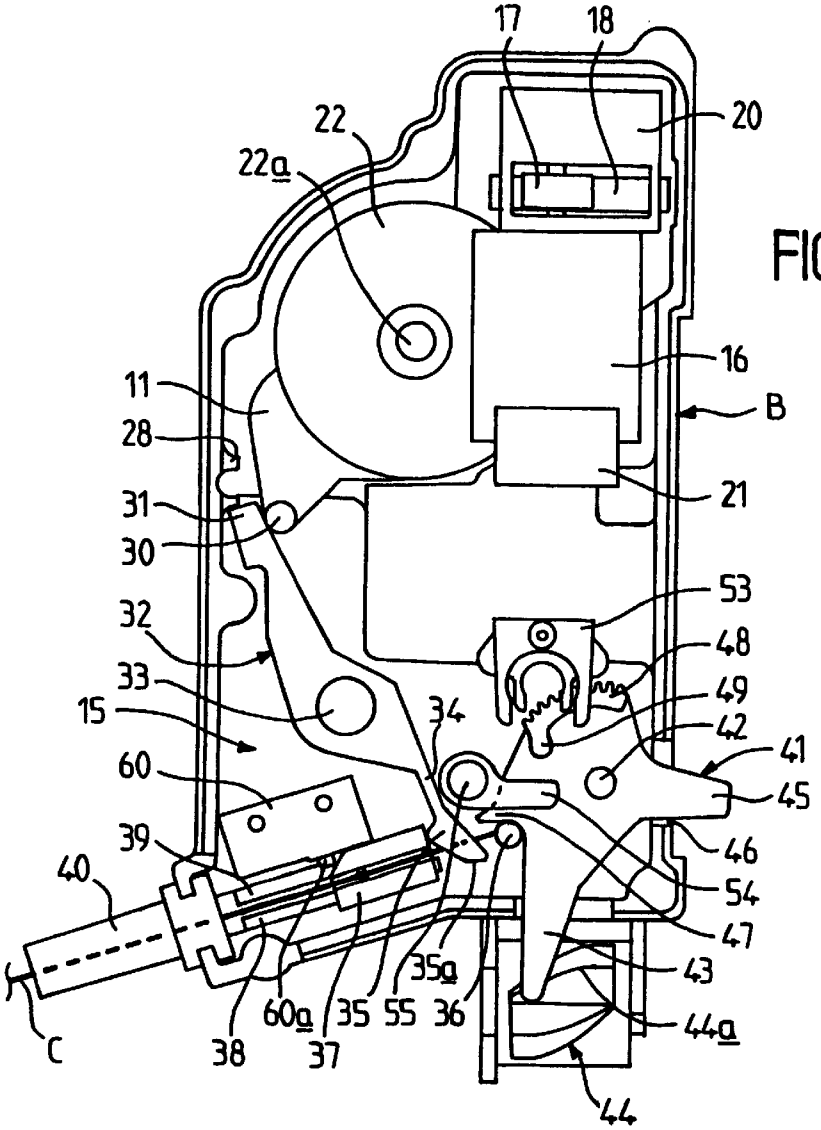
FIG. 6 is a view from above of FIG. 5, the driveline transmission compartment cover omitted, and the lock in a closed and unlocked position.

As can be seen in FIG. 6, a cable C passes between the branches of the fork 35 and, at its free end, has an endpiece 36 which is roughly spherical in shape, with a diameter which exceeds the separation of the branches of the fork 35, so that it can cause the emergency lever 32 to pivot about its shaft 33 by pulling on the cable C from a means for operating from the outside, for example an exterior door handle or paddle. The cable C is secured to a slider 37 arranged on the other side of the fork 35, with respect to the endpiece 36. The slider 37 may advantageously be overmolded onto the cable C. Two parallel guide rails 38, 39 are arranged on the bottom of the compartment 15 to guide the slider 37 as the cable C moves. The cable C extends out of the casing B, passing in sealed manner through a sleeve 40.

The driveline transmission compartment 15 furthermore comprises a locking lever 41 which is articulated on a length of shaft 42 projecting from the bottom of the compartment 15. The locking lever 41 comprises a first arm 43 which, at its free end, is fitted with a peg 43*a* which engages in a helical groove 44*a* formed on a rotary barrel 44. This rotary barrel 44 is intended to be connected to a lock cylinder for a front door. The locking lever 41 comprises a second arm 45 extending roughly radially towards the outside of the casing B, through an opening 46.

Figure 7:
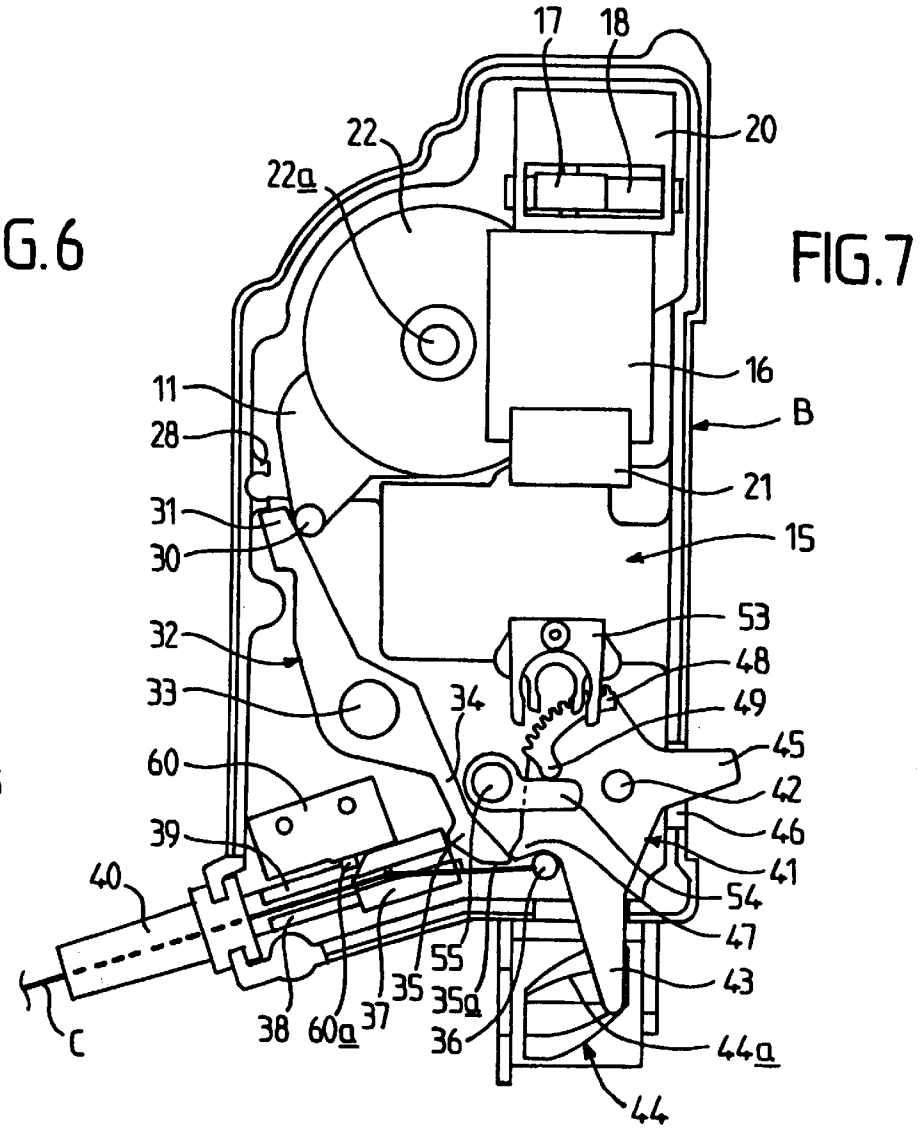
FIG. 7 is a view similar to FIG. 6, but depicting the lock in a closed and locked position.

The locking lever 41 has a third arm 47 which is intended to cooperate with the endpiece 36 of the cable C, to cause it to escape from the fork 35, as visible in FIG. 7. When the cable C is in the position of rest, the endpiece 36 lies in an indentation in the locking lever 41, which indentation is defined between the first arm 43 and the third arm 47.

The locking lever 41 further comprises a toothed sector 48 which is extended at one end by a projecting abutment 49. The toothed section 48 meshes with a pinion 50 borne by the drive shaft 51 of a second electric motor 52 for providing electrical assistance with locking/unlocking. The second electric motor 52 is borne by a support piece 53 with a roughly C-shaped profile, which is mounted on the bottom of the compartment 15.

The abutment 49 of the locking lever 41 is intended to cooperate with a second lever comprising an arm 54 extending radially from a shaft 55 which is mounted in a tubular sleeve 56 which projects from the bottom of the compartment 15. The shaft 55 passes, in sealed manner, through the bottom of the compartment 15 and at its lower end has a square section so that it can be secured in terms of rotation to the aforementioned lever 13.

Arranged along the rail 39 is a contactor 60 for opening from the outside, which comprises a button 60*a* which can be depressed by an inclined face 37*a* of the slider 37, as the cable C is pulled, so as to send an opening control signal to the first motor 16, via an electrical link, not depicted.

The lock which has just been described in conjunction with the appended drawing incorporates the four objectives of the invention, taken in combination. However, the various objectives of the invention may be taken in isolation or in combination with one another.

For example, in the case of the first object of the invention, one could, as an alternative, envisage an exterior door handle connected by a linkage to an articulated link rod in the sealed compartment of the lock, the contactor for opening from the outside being designed to detect the pivoting of this link rod.

In the case of the fourth object of the invention, one could, in the case of a mechanically opened lock, envisage replacing the emergency lever with a lever for opening from the outside which acts directly or indirectly on the pawl.

The way in which the lock of the invention works will now be described with reference to FIGS. 4 to 9.

In the position illustrated in FIG. 6, the lock is in its closed and mechanically unlocked state. Specifically, the locking lever 41 is in a position in which its arm 47 has placed the endpiece 36 of the cable C opposite the fork 35 of the emergency lever 32, which allows mechanical opening by pulling on the cable C, as explained later.

In this lock-closed position, it may be seen, in FIG. 4, that one of the branches of the fork of the latch 4 is immobilized by a nose of the pawl 5, to retain a striker, not depicted.

From the position illustrated in FIG. 6, when the user wishes to lock the lock, he or she has various options:

- if he or she is inside the vehicle interior, he or she can actuate an actuating member located on the inside of the door in order to move the arm 45 of the locking lever 41;
- if the user is outside the vehicle he or she can lock the lock using his or her key by inserting it into the cylinder of a front door lock so that the arm 43 of the locking lever can be made to move, via the barrel 44;
- again, from outside the vehicle, he or she can actuate a portable remote-control unit to send a signal commanding locking to the electric motor 52 providing assistance with locking, which motor 52 causes the locking lever 41 to pivot, by acting on the toothed sector 48.

Whatever the operating means used to lock the lock, the locking lever 41 pivots in the counter-clockwise direction, as illustrated in FIG. 7. In this figure, the lock is in its closed and mechanically locked state, because the arm 47 of the locking lever 41 has pushed the endpiece 36 of the cable C in a direction roughly perpendicular to the actuating travel of the cable C, so as to cause the endpiece 36 to escape the action of the fork 35 of the emergency lever 32. Thus, if an unauthorized person operates the exterior door handle to the full extent of its travel, in an attempt at driving the cable C, the endpiece 36 will slide along the arm 47 and the guide ramp 35*a* of the fork 35, without driving the emergency lever 32, it thus being impossible for the lock to be mechanically unlocked from the outside. As the cable C moves under the action of the exterior door handle, the slider 37 connected to the cable C will move along the guide rails 38 and 39 and its inclined face 37*a* will push the switch button 60*a* of the contactor 60 for opening from the outside, but as the overall vehicle power supply will not have been activated, the electric motor 16 for assisting with opening will remain inactive, thus also preventing electrical opening.

It may be seen, from FIG. 7, that when the lock is in the locked position, the abutment peg 49 of the locking lever 41 comes into contact with the arm 54 of the means for automatically unlocking on opening.

When the user wishes to return to the position of FIG. 6, he or she actuates one of the aforementioned operating means in order to cause the locking lever 41 to pivot in the clockwise direction of FIG. 7 to FIG. 6. In this case, the endpiece 36 of the cable C accompanies the pivoting of the arm 47 of the locking lever 41, because it is returned by the inherent elasticity of the cable C to its position of rest illustrated in FIG. 6.

Figure 8:
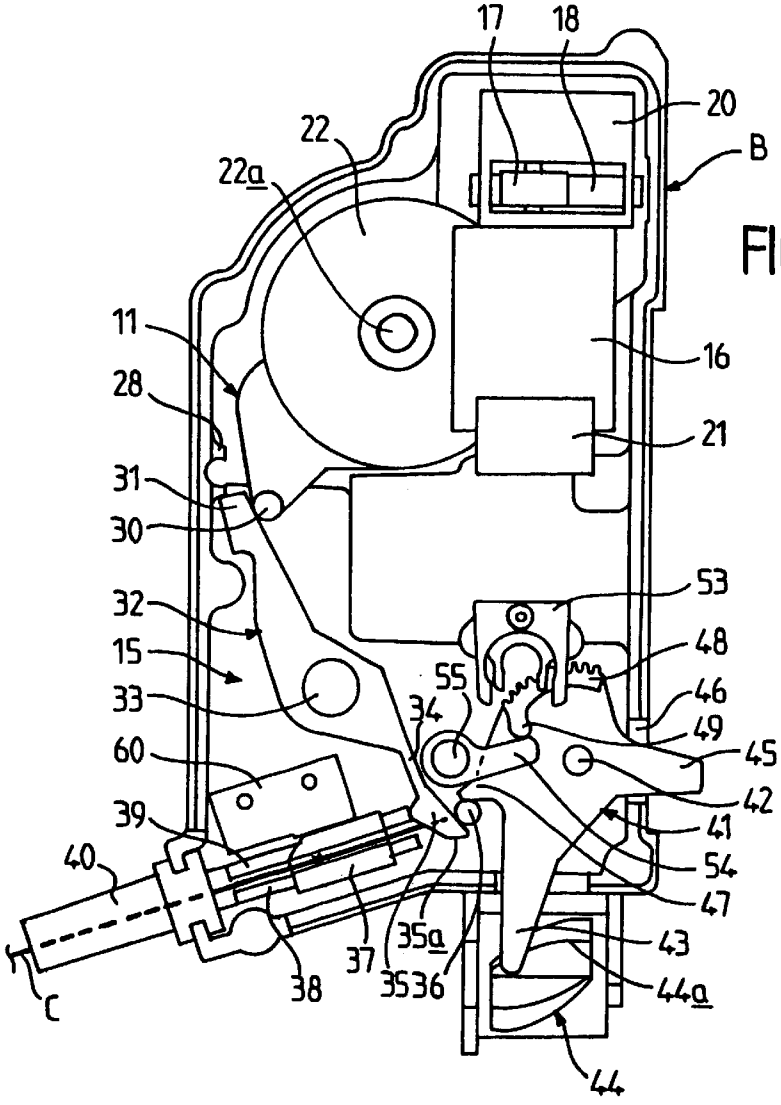
FIG. 8 is a view similar to FIG. 6, but depicting the lock in an open and unlocked position, under the action of the electrical device for assisting with opening.

The passage of the lock from its closed unlocked position illustrated in FIG. 6 to its open position, open by virtue of the electrical device for assisting with opening, in FIG. 8, will now be described. Thus, when the user grasps the exterior door handle and actuates it lightly, the cable C moves over a short travel, as illustrated between FIGS. 6 and 8. At the end of the actuating travel of the cable C, the endpiece 36 of the cable comes at most into contact with the fork 35 of the emergency lever, without actuating this lever. The slider 37 which is secured to the cable C, moves by a corresponding travel and retracts the button 60*a* of the contactor 60. Given that the overall vehicle power supply will have already been switched on by the recognition system, the contactor 60 can send an opening control signal to the electric motor 16 which will rotate the wheel 22 in the clockwise direction. As the wheel 22 rotates, the wrist pin 24 comes into contact with the arm 11*b* of the operating lever 11 and pushes on it, so as to cause the operating lever 11 to pivot in the counter-clockwise direction in FIG. 5. The wrist pin 24 pushes on the arm 11*b* of the operating lever 11 until the finger 23*a* comes up against the elastic end-of-travel stop 27.

The pivoting of the operating lever 11 causes the lever 9 for opening from the outside to pivot in the retention compartment 3 in the clockwise direction in FIG. 4. As it pivots, the lever 9 for opening from the outside via its arm 9*a* pushes on the finger 5*a* of the pawl 5 to cause the pawl 5 to pivot in the counter-clockwise direction, thus releasing the latch 4 which, in turn, can pivot in the counter-clockwise direction to release the striker.

When the finger 23*a* comes to rest against the stop 27, the pawl 5 will have released the latch 4.

The driving torque exerted by motor 16 will be maintained for a determined time by a timer, to ensure that the wrist pin 24 does indeed cause the operating lever 11 to pivot. As soon as the drive supplied by the motor 16 ceases, the worm 19 will be rotated back in the opposite direction by a spiral spring (not depicted), so as to return the wheel 22, and therefore the wrist pins 24 and 25, to their initial positions, to allow later opening. The spiral spring is connected to the worm 19 and coils up as the motor 16 provides drive. Advantageously, the spiral return spring for the worm 19 is arranged in the bearing 20. In this configuration, the operating lever 11 returns to its position of rest under the action of a return spring, not depicted.

Referring again to FIG. 4, when the latch 4 pivots in the counter-clockwise direction to release the striker, the cam follower peg 13*a* of the lever 13 follows the cam profile 4*a* of the latch 4, and this causes the lever 13 to pivot in the clockwise direction in FIG. 4. At roughly the end of pivoting travel of the latch 4, the peg 13*a* of the lever 13 presses the button 14*a* of the door-open contactor 14 to signal to a central processing unit that the door is open. The pivoting of the lever 13 causes the simultaneous pivoting of the arm 54 in the driveline transmission compartment 15 in the counter-clockwise direction, as depicted in FIG. 8, to bring the arm 54 of this lever into contact with the abutment 49 on the locking lever 41.

It is thus impossible to lock the lock while the door is open, because any pivoting of the locking lever 41 in the counter-clockwise direction is prevented by the arm 54 which is immobilized in position by the lever 13, the cam follower peg 13*a* of which is resting against the cam profile 4*a* of the latch 4.

The electrical device for assisting with opening operates in the same way starting from the position of FIG. 7, in which the lock is in its closed and mechanically locked state. Thus, the authorized user wearing a badge equipped with an emitter for emitting a determined coded signal, approaches the vehicle which is fitted with a recognition system comprising a receiver capable of decoding the signal and of switching on the electrical power supply of the vehicle when the authorized user has been duly identified. When the user pulls on the cable C by a short travel in order to trigger the emission of an opening control signal by the contactor 60, the electric motor 16 causes the lock to open, and the latch 4 via its cam profile 4*a,* causes the arm 54 to pivot in the counter-clockwise direction to push on the abutment peg 49 of the locking lever 41, causing the latter to pivot in the clockwise direction to bring it into an unlocked position. In other words, starting from FIG. 6 or starting from FIG. 7, it is the same position depicted in FIG. 8 which is reached when the device for assisting with opening is activated. Thus, automatic unlocking on opening is achieved, when the means for operating from the outside is actuated. This is made possible by the fact that the two drivelines—one for the opening mechanism and one for the locking mechanism—are dissociated.

The contactor 60 sends a control signal simultaneously to the motor 16 and to the motor 52, to simultaneously provide assistance with opening the door and unlocking the other doors.

Figure 9:
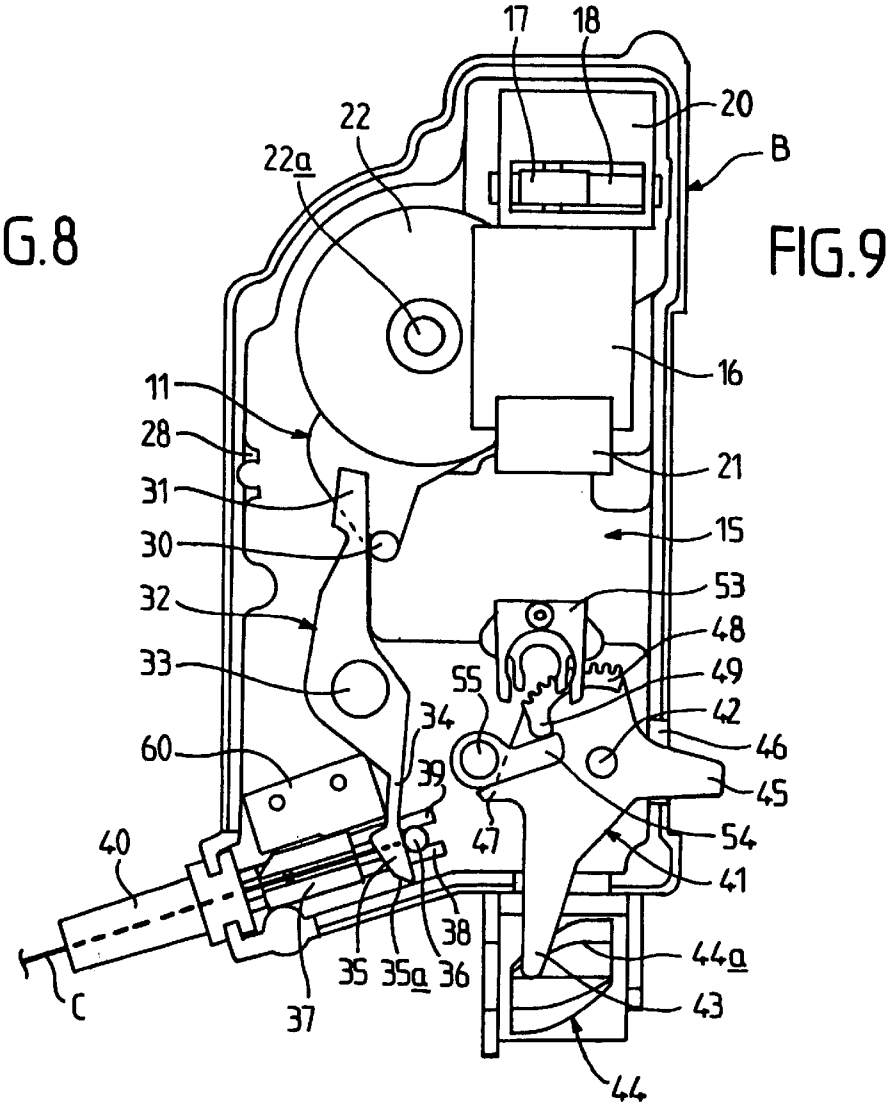
FIG. 9 is a view similar to FIG. 8, the lock being also in the open and unlocked position, under the action of the emergency mechanical means of opening.

Finally, if the device for assisting with opening does not work, on account of an electrical fault or insufficient charge in the vehicle battery, the user can open the lock mechanically having unlocked it mechanically, for example, using the lock cylinder, by pulling the cable C over an additional travel, so that the fork 35 of the emergency lever 32 can be driven by the endpiece 36 to make it pivot in the clockwise direction in FIG. 9 and push, via the bent tab 31 of its opposite arm, the peg 30 of the operating lever 11 to cause it to pivot in the counter-clockwise direction, which causes the lever 9 for opening from the outside to pivot and consequently causes the latch to be released. In the same way, the arm 54 comes into contact with the abutment 49 of the locking lever 41, because of the cooperation between the cam profile 4*a* of the latch 4 and the cam follower peg 13*a* of the lever 13.

Note that the wrist pin 25 depicted in FIG. 5 is of no particular use here.

The electric motor 52 is reversible, so that the locking lever 41 can be pivoted in both directions, to bring it respectively into its locked position or into its unlocked position.

The drive shaft 51 of the electric motor 52 has its axis of rotation parallel to the axis of pivoting of the locking lever 41, whereas the drive shaft of the electric motor 16 has its axis of rotation at right angles to the axis of the opening lever 9.

Although the invention has been described in conjunction with a particular embodiment, it is quite clear that it is not in any way restricted thereto and that it comprises all technical equivalents of the means described and combinations thereof where these fall within the scope of the invention.

What is claimed is:

1. Electric lock for a motor vehicle door, comprising a lock casing (B), of which a first compartment (3), known as the retention compartment, contains a latch (4) capable of retaining a striker and a pawl (5) for immobilizing the latch in a striker-retaining position, and of which a second compartment (15), known as the driveline transmission compartment, contains, in sealed manner, a locking mechanism comprising a locking lever (41) capable of placing the lock in a locked/unlocked position, and an opening mechanism comprising an electric motor (16) for assisting with opening, characterized in that, in the second, driveline transmission, compartment (15), the electric motor (16) is coupled, via a set of gears (17–19), to a gear wheel (22) having at least one radially eccentric wrist pin (24) and a radially eccentric peg (23*a*), said wrist pin being able to engage an operating lever (11) in said second, driveline transmission compartment (15), so that when the electric motor (16) is supplied with electrical power, the electric motor rotates said gear wheel (22) and, as said gear wheel rotates, said wrist pin (24) drives said operating lever (11) until said radially eccentric peg (23*a*) on said gear wheel comes into contact with an elastic end-of-opening travel stop (27), the supply of electrical power to the motor being timed to last long enough to ensure said peg reaching the elastic stop, said operating lever rotating as one with an opening lever (9) arranged in the first, retention, compartment (3) and capable of cooperating with the pawl (5) to move said pawl into a releasing position for releasing the latch (4).

2. Lock according to claim 1, characterized in that the set of gears comprises a first pinion (17) secured to a drive shaft of the electric motor (16) and meshing with a second pinion (18) secured to a worm (19) which meshes peripherally with said gear wheel (22), said worm being connected to a spiral return spring which causes the worm to rotate in an opposite direction when the power supply to the motor is cut, thus causing the wrist pin (24) of the gear wheel (22) to return to an initial position.

3. Lock according to claim 1, characterized in that the locking mechanism comprises a reversible second electric motor (52) for assisting with locking/unlocking the lock, the second electric motor having a drive shaft (51) fitted with a pinion (50) meshing with a toothed sector (48) of the locking lever (41).

4. Lock according to claim 1, characterized in that the electric motor (16) for assisting with opening drives the opening lever (9) in response to a control signal emitted by a contactor (60) for opening from the outside, when an external operating means of the motor vehicle door in which the lock is fitted is actuated by a user.

5. Lock according to claim 4, characterized in that said lock further comprises an outside mechanical linkage means (C) having an outer portion which is connectible with said external operating means, and another, inner, portion which extends into the sealed second compartment (15) of the lock, said contactor (60) for opening from the outside being arranged in said sealed second compartment on a path of travel of said inner portion of the outside mechanical linkage means (C), so as to emit an opening-from-the-outside control signal when the outer portion of the outside mechanical linkage means is connected to said external operating means and the outside mechanical linkage means is moved over a determined opening travel when said external operating means is being actuated.

6. Lock according to claim 1, characterized in that the locking lever (41) comprises three arms: a first arm (47) for placing a mechanical linkage means (C) for linking to an external operating means in a locked or unlocked position; a second arm (43) for linking with a lock barrel; and a third arm (45) for linking with a member for operating the door from the inside.

7. Lock according to claim 1, characterized in that the opening mechanism comprises an emergency lever (32) for mechanical opening in the event of an electrical fault or failure of the vehicle battery, said emergency lever comprising a first branch (31) cooperating with a peg (30) projecting from the operating lever (11), and a second branch (34) cooperating with a mechanical linkage means (C) for linking to an external operating means, when the lock is in an unlocked state.

8. Lock according to claim 1, characterized in that said lock further comprises a means for automatically unlocking upon opening, comprising a first lever (13) having a cam follower element **(13*a*) arranged in the first, retention, compartment (3) to cooperate with a cam profile (4*a*) provided on the latch (4), and a second lever (54) arranged in the sealed second compartment (15) and capable of cooperating with an abutment (49) provided on the locking lever (41), so that as the latch rotates into an open position, the cam profile causes a movement of the cam follower element and consequently of the second lever (54) which rotates as one with the first lever (13), to automatically bring the locking lever (41)** into an unlocked position.

9. Lock according to claim 8, characterized in that the second lever (54) of the means for automatically unlocking on opening is capable, when the latch is in the open position, of immobilizing the abutment (49) of the locking lever (41) so as to prevent the lock from being locked in the door-open position.

10. Lock according to claim 1, characterized in that the pawl 5 is connected to a means for operating from the inside by means of a mechanical linkage means to bring the pawl into a position for releasing the latch (4).

11. Lock according to claim 2, characterized in that the locking mechanism comprises a reversible second electric motor for assisting with locking/unlocking the lock, the second electric motor having a drive shaft fitted with a pinion meshing with a toothed sector of the locking lever.

12. Lock according to claim 2, characterized in that the electric motor for assisting with opening drives the opening lever in response to a control signal emitted by a contactor for opening from the outside, when an external operating means of the motor vehicle door in which the lock is fitted is actuated by a user.

13. Lock according to claim 3, characterized in that the electric motor for assisting with opening drives the opening lever in response to a control signal emitted by a contactor for opening from the outside, when an external operating of the motor vehicle door in which the lock is fitted is actuated by a user.

14. Lock according to claim 2, characterized in that the locking lever comprises three arms: a first arm for placing a mechanical linkage means for linking to an external operating means in a locked or unlocked position; a second arm for linking with a lock barrel; and a third arm for linking with a member for operating the door from the inside.

15. Lock according to claim 3, characterized in that the locking lever comprises three arms: a first arm for placing a mechanical linkage means for linking to an external operating means in a locked or unlocked position; a second arm for linking with a lock barrel; and a third arm for linking with a member for operating the door from the inside.

16. Lock according to claim 4, characterized in that the locking lever comprises three arms: a first arm for placing a mechanical linkage means for linking to an external operating means in a locked or unlocked position; a second arm for linking with a lock barrel; and a third arm for linking with a member for operating the door from the inside.

17. Lock according to claim 5, characterized in that the locking lever comprises three arms: a first arm for placing a mechanical linkage means for linking to an external operating means in a locked or unlocked position; a second arm for linking with a lock barrel; and a third arm for linking with a member for operating the door from the inside.

18. Lock according to claim 2, characterized in that the opening mechanism comprises an emergency lever for mechanical opening in the event of an electrical fault or failure of the vehicle battery, said emergency lever comprising a first branch cooperating with a peg projecting from the operating lever, and a second branch cooperating with a mechanical linkage means for linking to an external operating means, when the lock is in an unlocked state.

19. Lock according to claim 3, characterized in that the opening mechanism comprises an emergency lever for mechanical opening in the event of an electrical fault or failure of the vehicle battery, said emergency lever comprising a first branch cooperating with a peg projecting from the operating lever, and a second branch cooperating with a mechanical linkage means for linking to an external operating means, when the lock is in an unlocked state.

20. Lock according to claim 4, characterized in that the opening mechanism comprises an emergency lever for mechanical opening in the event of an electrical fault or failure of the vehicle battery, said emergency lever comprising a first branch cooperating with a peg projecting from the operating lever, and a second branch cooperating with a mechanical linkage means for linking to an external operating means, when the lock is in an unlocked state.

21. Lock according to claim 1, characterized in that the supply of electrical power to the motor is timed to last approximately 100 ms.

* * * * *